US012575678B2

(12) United States Patent
Coghlan

(10) Patent No.: US 12,575,678 B2
(45) Date of Patent: Mar. 17, 2026

(54) MODULAR SELF-LOCKING CHAIR WITH INTERLOCKING JOINT SYSTEM

(71) Applicant: Conor Coghlan, Brooklyn, NY (US)

(72) Inventor: Conor Coghlan, Brooklyn, NY (US)

(73) Assignee: CIPG, LLC, Brooklyn, NY (US)

( * ) Notice: Subject to any disclaimer, the term of this patent is extended or adjusted under 35 U.S.C. 154(b) by 0 days.

(21) Appl. No.: 19/080,742

(22) Filed: Mar. 14, 2025

(65) Prior Publication Data

US 2025/0288111 A1 Sep. 18, 2025

Related U.S. Application Data

(60) Provisional application No. 63/565,515, filed on Mar. 14, 2024.

(51) Int. Cl.
*A47C 4/02* (2006.01)
*A47C 4/03* (2006.01)

(52) U.S. Cl.
CPC ..... *A47C 4/021* (2013.01); *A47C 4/03* (2013.01)

(58) Field of Classification Search
CPC ..... A47C 4/021; A47C 4/03
USPC ..... 297/440.1, 440.13–440.15, 440.2
See application file for complete search history.

(56) References Cited

U.S. PATENT DOCUMENTS

| | | | | |
|---|---|---|---|---|
| 2,444,991 | A * | 7/1948 | Hunter | A47C 4/021 297/440.13 |
| 2,628,668 | A * | 2/1953 | Basile | A47C 4/021 297/440.13 |
| 4,974,906 | A * | 12/1990 | Hines | A47C 4/021 297/440.13 |
| 6,247,754 | B1 | 6/2001 | Vanderaue et al. | |
| 8,353,560 | B2 | 1/2013 | Grove | |
| 8,919,885 | B2 | 12/2014 | Han | |
| 2007/0228902 | A1 | 10/2007 | Frey et al. | |
| 2010/0276971 | A1* | 11/2010 | Maxwell | A47C 4/02 297/440.13 |
| 2011/0084536 | A1 | 4/2011 | Huang | |

* cited by examiner

*Primary Examiner* — Robert Canfield
(74) *Attorney, Agent, or Firm* — Brooklyn Law Incubator & Policy Clinic; Serge Krimnus

(57) ABSTRACT

A modular self-locking chair includes two vertical frames comprising of a flexible joint attached at the top of the first and second vertical frames. The chair may include two horizontal frames each including two joint frames and an indentation on an intermediate underside section of one horizontal frame and the other horizontal frame may have an indentation on an intermediate topside section. Each horizontal frame may attach to one of the vertical frames to form two leg assemblies. Aspects of the present disclosure may include a backrest that may include one or more latches attached to the back section of the backrest, a seat base with two or more half-lap joints attached to the underside section of the seat base, and a bow-shaped joint which may attach to an underside section of the seat base.

20 Claims, 17 Drawing Sheets

MODULAR SELF-LOCKING CHAIR WITH INTERLOCKING JOINT SYSTEM

FIELD OF INVENTION

The present disclosure relates to furniture, and more particularly, to a self-locking chair with the use of little to no hardware.

INTRODUCTION

As one of the most common furniture pieces used by people around the world, chairs are essential to people's everyday activities. Traditional chairs often require multiple fasteners and tools for assembly, which can be cumbersome for users and might lead to lost components or improper assembly. Many consumers find assembling furniture to be a tedious and sometimes frustrating process, especially when dealing with small, easily misplaced parts. In addition to the complex assembling process, screw-based connections on furniture pieces can loosen over time, reducing structural integrity and stability, particularly on chairs, as they have to bear weights constantly. This degradation in stability can lead to potential safety concerns and hazards, causing discomfort or even injury to users.

Additionally, having a high quantity of parts increases environmental concerns, as the production fasteners and additional hardware components requires the extraction, processing, and manufacturing of raw materials, contributing to resource depletion and carbon emissions. Many traditional furniture designs utilize a mix of different materials for their fasteners and hardware, some of which are difficult to recycle or dispose of sustainably. Therefore, the more components a design incorporates, the greater the likelihood of waste being generated at the end of its lifecycle, further contributing to the pre-existing environmental issues. Furniture disposal has become a growing concern as landfill waste from discarded furniture and other household items continues to rise. In response to this issue, there has been a rising demand in the market for furniture solutions that can minimize the use of excess materials while maintaining functionality and stability.

Furthermore, fasteners for traditional chairs often loosen over time, especially in frequently used furniture, leading to instability and requiring maintenance or repairs to ensure continued usability. This deterioration is especially problematic in high-traffic and populated environments such as offices, restaurants, and other public seating areas, along with dining and living rooms of one's own home, where chairs are subjected to continuous pressure during use and wear. The need for periodic maintenance or replacement of fasteners not only adds to the overall costs but also inconveniences users relying on the chairs' structural integrity. Furthermore, repeated tightening of fasteners can lead to stripped screw threads or damaged material of the chair itself, ultimately compromising the entire structure and the usability of the furniture. The issue might be more challenging for users in some situations where specialized tools are required for repairs due to the designs of the chairs and fasteners, as users might find themselves unable to address and fix minor issues without professional repair services, potentially leading to premature and unnecessary furniture replacement.

Therefore, there is a need for an improved chair assembly system that eliminates the need for traditional fasteners while improving the strength and stability of traditional chairs. Simplifying the assembly process can enhance user experience, lower the risks associated with improper assembly, and ultimately reduce frustration. Additionally, eliminating reliance on fasteners during chair assembly can create a more sustainable manufacturing practice by decreasing waste generation and improving the recyclability of a chair.

SUMMARY

In as aspect described herein, a self-locking chair is disclosed. The chair may comprise a first and a second vertical frame. Each vertical frame may comprise of a flexible joint attached at the top of the frame. The chair may also comprise a first and a second horizontal frame. Each horizontal frame may have a first, a second, a third, and a fourth joint attached to a top surface. The first horizontal frame may have an indentation on an intermediate underside section. The second horizontal frame may have an indentation on an intermediate topside section. The first horizontal frame may attach to the first vertical frame, while the second horizontal frame may attach to the second vertical frame. These attachments may form a first a second leg assembly.

The chair may further comprise a backrest. The backrest may have a first and second latch attached to a back section. The chair may also include a seat base. The seat base may have a first and a second half lap joint attached to a proximal underside section. The seat base may further have a bow-shaped joint attached to a distal underside section.

The chair may further include additional structural features. The first and the second frame joints may attach to a proximal end of the first and the second horizontal frames. The third and the fourth frame joints may attach to a distal end of the first and the second horizontal frames. The first and the second latches on the backrest may be attached to opposing horizontal sides of the rear section of the backrest. The first and the second half lap joints may be attached to a proximal side and positioned in opposing horizontal alignment on the underside section of the seat base.

The first and the second horizontal frames may attach to the first and the second vertical frames via a hinge mechanism to form the first and the second leg assemblies. Each hinge mechanism may include screws securing the first and the second vertical frames. The components of the chair, including the latches, the half lap joints, the flexible joints, the frame joints, and the bow-shaped joint, may be composed of a recycled high-density polyethylene plastic or a material that is capable of flexibility and durability to secure components in a self-locking mechanism.

The indentations on the first and the second horizontal frames may be a rectangular shape or another shape that secures the first and the second horizontal frames to couple to each other. The backrest may have a curved shape to conform to the natural contours of a user's back, providing ergonomic support for comfortable sitting.

The first and the second vertical frames, the first and the second horizontal frames, the backrest, and the seat base may be composed of wood, plastic, or any other material that is durable to provide support for comfortable siting for the user. The flexible joint attached to the vertical frames may have a hooked shape on a top and a bottom section of the flexible joint or any other shape that provides secure latching for the self-locking mechanism.

In an aspect described herein, a method of assembling a self-locking chair is disclosed. The method may include compiling the first leg assembly to the second leg assembly. The indentation on the intermediate underside section of the first leg assembly may align with and be pushed downward into the indentation on the intermediate topside section of the second leg assembly, thereby securing the two leg assemblies together. The method may further include securing the backrest onto the first and the second vertical frames. The first and the second latches on the back of the backrest may align with and secure onto the first and the second flexible joints attached to the top of the first and the second vertical frames, thereby providing a secure attachment of the backrest to the two secured leg assemblies. The method may also include securing the seat base onto the first and the second horizontal frames. The first and the second half-lap joints attached to the proximal underside section of the seat based may align and secure to the first and the second frame joints on the proximal end of the first and the second horizontal frames. The bow-shaped joint attached to the distal underside section of the seat base may be clipped to the third and the fourth frame joints attached to the distal side of the horizontal frames.

The method may further include securing each latch attached to the backrest to a respective flexible joint on the vertical frames. The bottom of each latch may be placed into the flexible joint, and the top of each latch may then be pushed into the flexible joint. Each hook on the flexible joint may engage with the top and the bottom of each latch to secure them together.

The first and the second half-lap joints attached to the seat based may horizontally slide into the first and the second frame joints on the proximal end of the horizontal frame to interlock. The distal side of the seat base may then be pushed downward while squeezing the bow-shaped joint inward in order to clip into the third and the fourth frame joints near the intersection horizontal frames, thereby securing the seat based to the first and the second secured leg assemblies.

The intersecting horizontal frames may be oriented at a ninety-degree angle.

In another aspect described herein, a method of disassembling the self-locking chair is disclosed. The method may include releasing the seat based from the horizontal frames. The bow-shaped joint attached to the distal underside section of the seat base may be disengaged and released from the third and the fourth joint frames attached to the distal end of the first and the second horizontal frames near their intersection. The first and the second half-lap joints attached to the proximal underside section of the seat base may also be disengaged and released from the first and the second joint frames attached to the proximal ends of the first and the second horizontal frames, leading to the removal of the seat base from the two secured leg assemblies. The method may further include releasing the backrest from the first and the second vertical frames. The firsts and the second latches on the back of the backrest may be disengaged from the first and the second hook-shaped flexible joints attached to the top of the first and the second vertical frames, allowing for the removal for the backrest from the leg assemblies.

The method may further include the bow shaped joint attaching to the underside section of the seat base. The bow shaped joint may be squeezed inward and vertically disengaged from the joint frames attached to the distal end of the horizontal frames. Additionally, the half lap joints attached to the underside section of the seat base may be pulled laterally from the first and second joint frames attached to the proximal end of the horizontal frames which may provide for the removal of the seat base from the first and second leg assemblies.

The first and the second latches attached to the back of the backrest may be disengaged from the respective flexible joints attached to the top of the first and the second vertical frames by withdrawing the top section of each latch from the top section of each hook-shaped flexible joint, providing for the removal of the backrest.

The intersection horizontal frames may remain oriented at a ninety-degree angle during disassembly.

The first leg assembly may be decoupled by hoisting the first horizontal frame from the second horizontal frame, providing for the release for the indentation in the first horizontal frame from the indentation in the second horizontal frame.

BRIEF DESCRIPTION OF THE DRAWINGS

The incorporated drawings, which are incorporated in and constitute a part of this specification exemplify the aspects of the present disclosure and, together with the description, explain and illustrate principles of this disclosure.

DETAILED DESCRIPTION

In the following detailed description, reference will be made to the accompanying drawing(s), in which identical functional elements are designated with like numerals. The accompanying drawings show by way of illustration, and not by way of limitation, specific aspects, and implementations consistent with the principles of this disclosure. These implementations are described in sufficient detail to enable those skilled in the art to practice the disclosure, and it is to be understood that other implementations may be utilized, and that structural changes and/or substitutions of various elements may be made without departing from the scope and spirit of this disclosure. The following detailed description is, therefore, not to be construed in a limited sense.

Figure 1A:
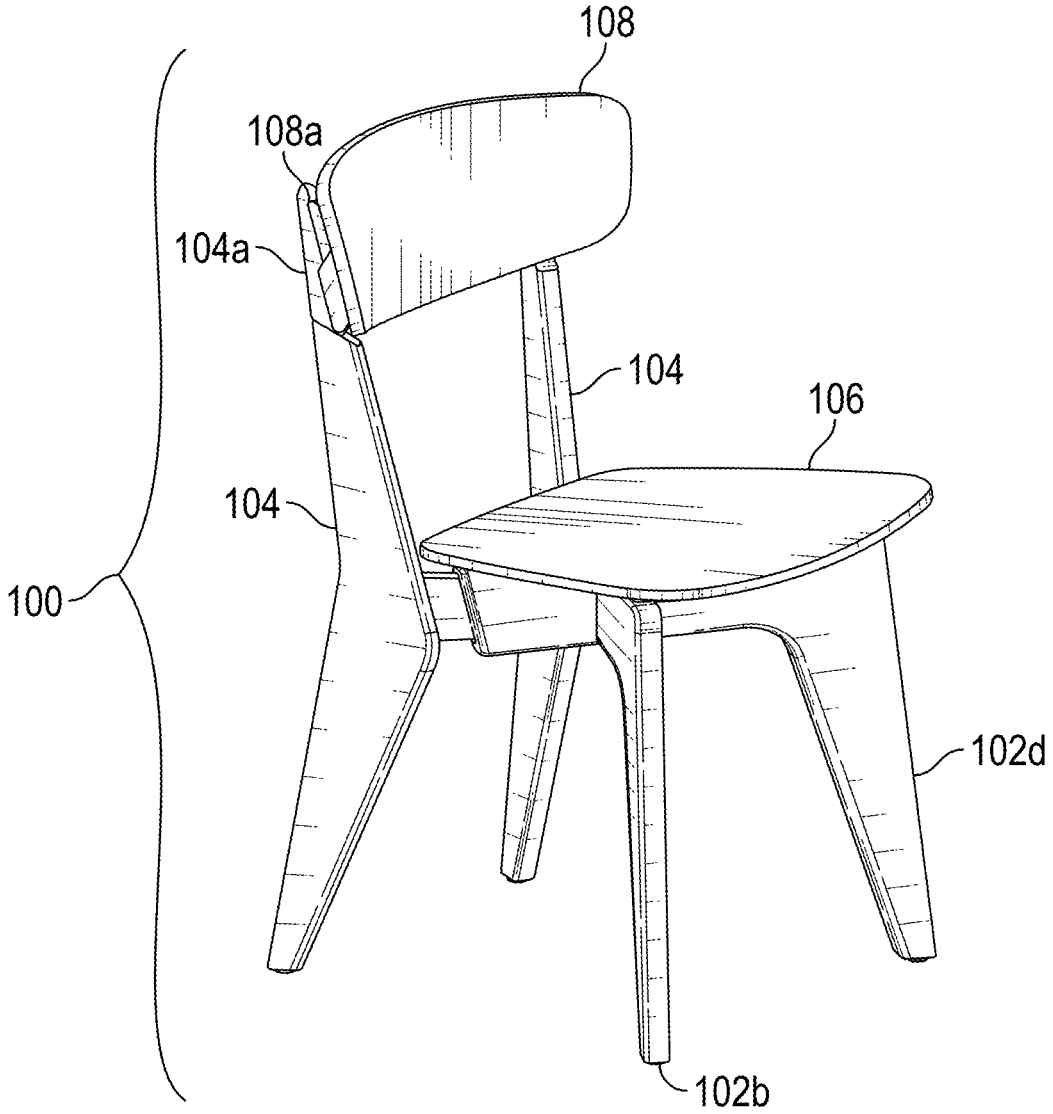
FIG. 1A illustrates a chair according to various aspects of the present disclosure.
Figure 1B:
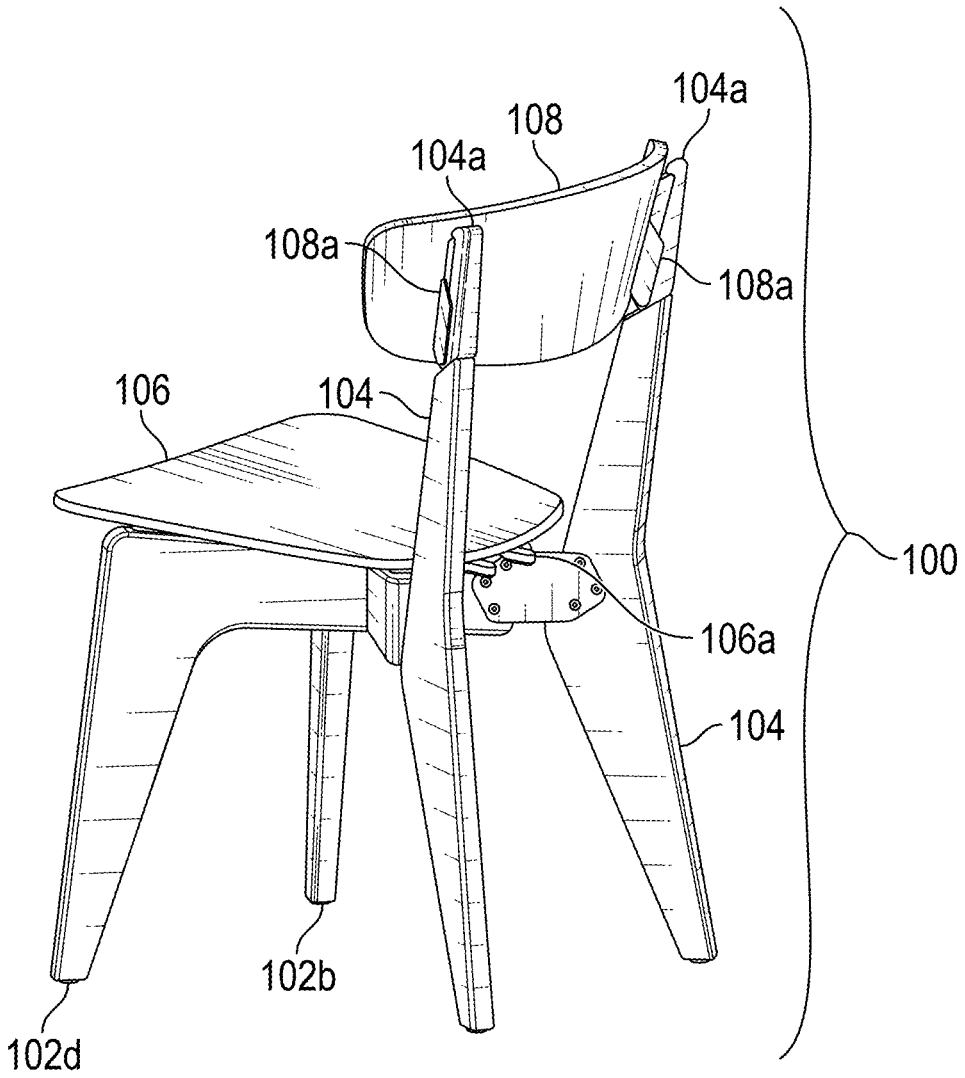
FIG. 1B illustrates a chair according to FIG. 1A.
Figure 1C:
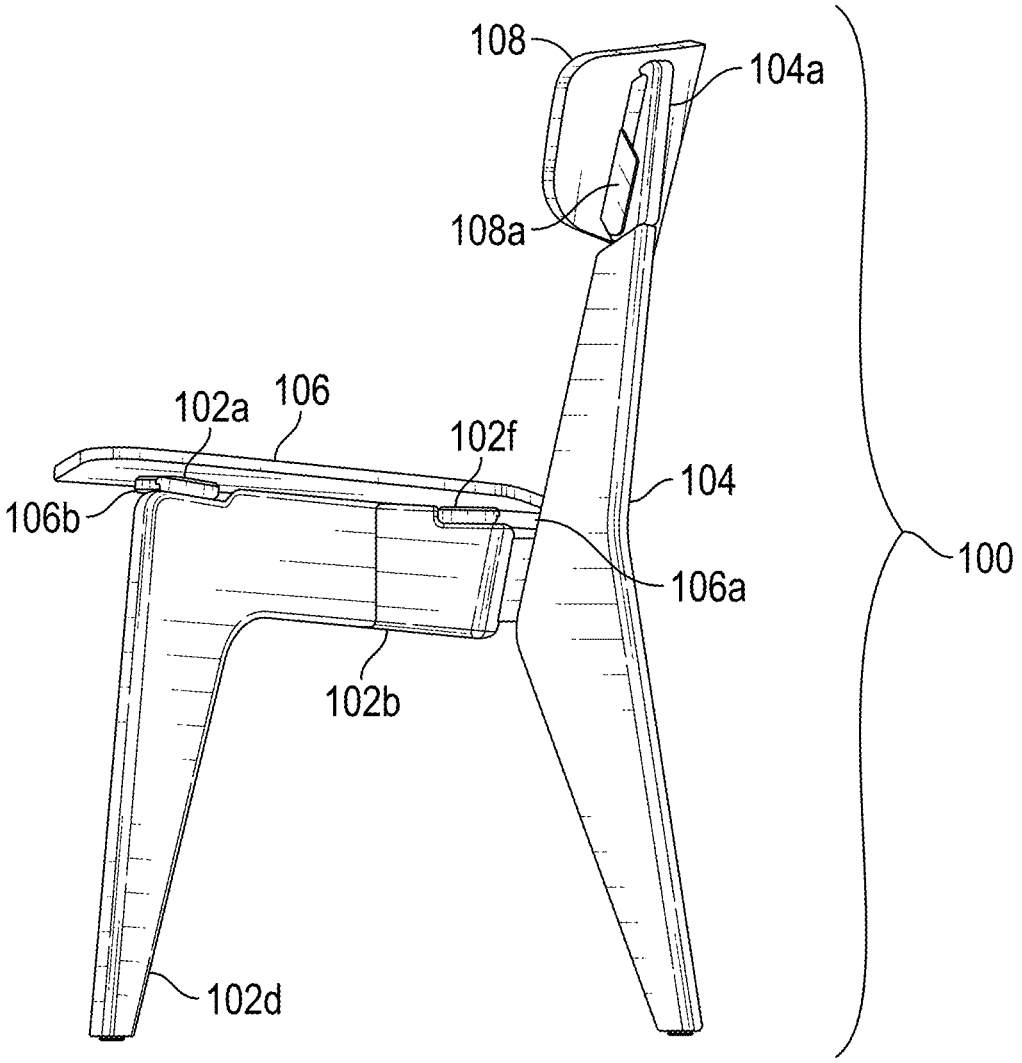
FIG. 1C illustrates a chair according to FIG. 1A.

As illustrated in FIG. 1A-C, an embodiment of a self-locking chair 100 comprises two vertical frames 104 attached to two horizontal frames 102*b* and 102*d*, a backrest 108, and a seat base 106. Aspects of the present disclosure relate to using a precision-engineered interlocking system that enables components to securely click together, forming a durable yet non-complicated structure. In one embodiment, the self-locking chair pieces 102*b*, 102*d*, 104, 106, 108 may suitability be made of any material while the joints 102*a*, 102*c*, 102*e*, 102*f*, 104*a*, 106*a*, 108*a* may be made of recycled high-density polyethylene (HDPE) plastic. Such plastic may allow flexible joint systems that facilitate attachment, allowing a user to snap or click pieces to assemble or dissemble the chair quickly and easily. Furthermore, the self-locking chair 100 may be manufactured from a range of materials, including wood, plastic, metal composites, and others, based on the needs of consumers, offering versatility in design and aesthetic appeal.

The horizontal frames 102*b* and 102*d* may attach to two vertical frame 104 to form two or more leg assemblies. Each horizontal frame 102*b* and 102*d* may attach to a separate vertical frame 104. The attachment may comprise a hinge with three screws on each frame 102*b*, 102*d*, 104. A variety of screws may work to keep the horizontal frames 102*b* and 102*d* attached to the two vertical frames 104.

Figure 2A:
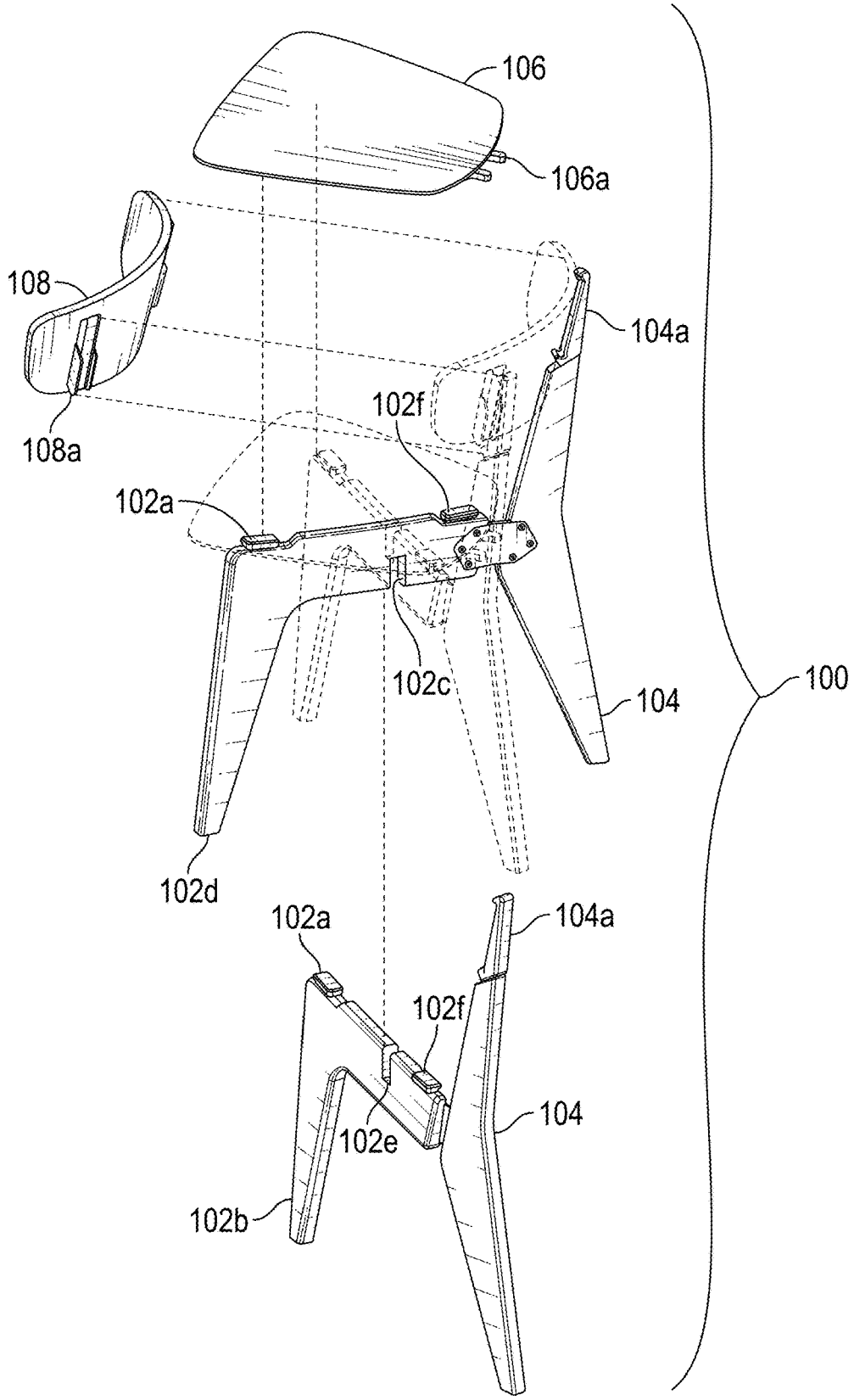
FIG. 2A illustrates an exploded view of a chair according to various aspects of the present disclosure.
Figure 2B:
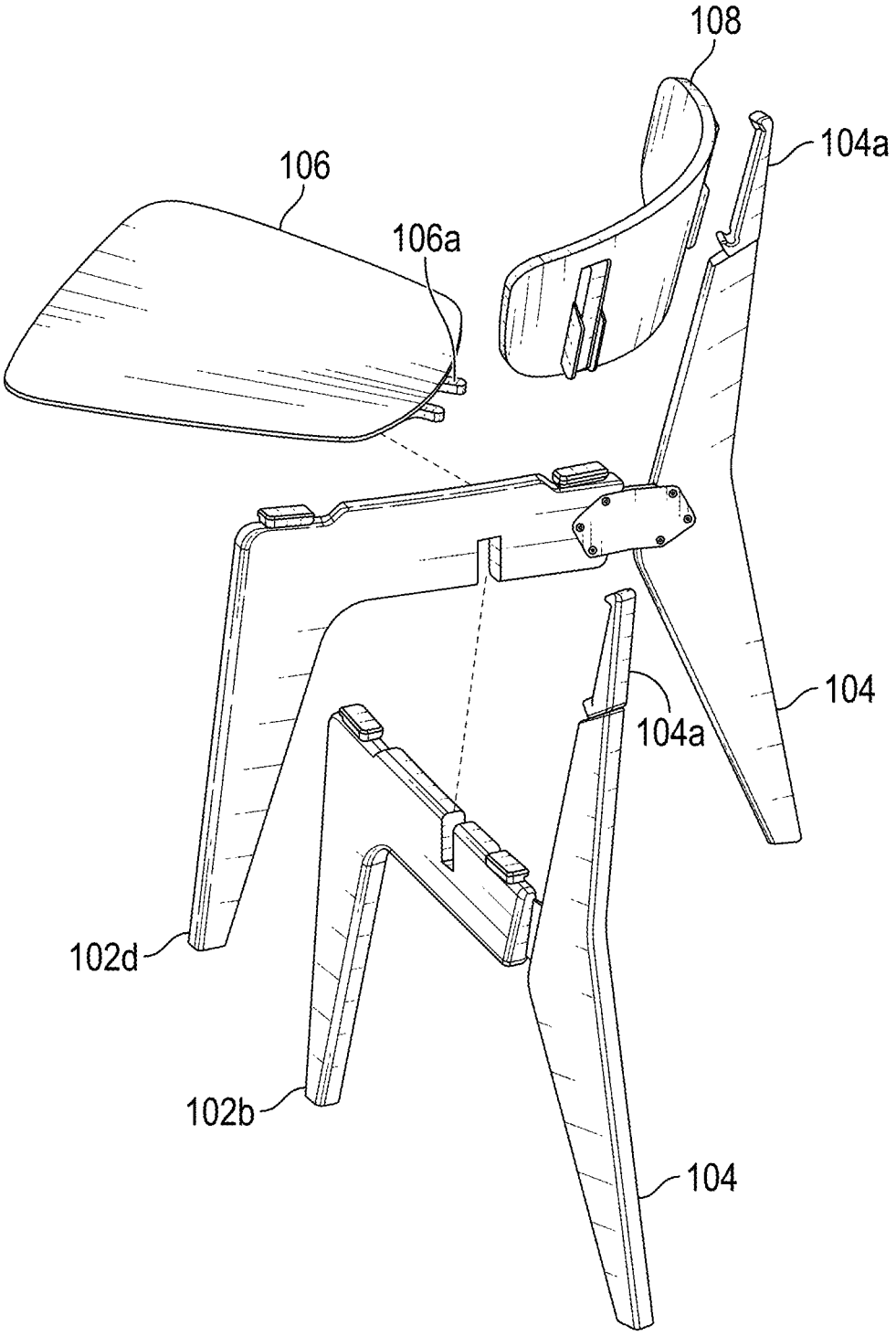
FIG. 2B illustrates an exploded view of the chair according to various aspects of the present disclosure.

FIG. 2A-B illustrates an exploded view of the chair. In such an embodiment one or more joint frames 102*a*, 102*f* are attached to the horizontal frames 102*b*, 102*d*. One or more bow-shaped joints 106*a* may be attached to seat base 106. One or more latches 108*a* may be attached to the backrest 108. There may be one or more flexible joints attached to a vertical frame. There may be more than one indentation 102*c*, 102*e* on the horizontal frames 102*b*, 102*d*.

Figure 3A:
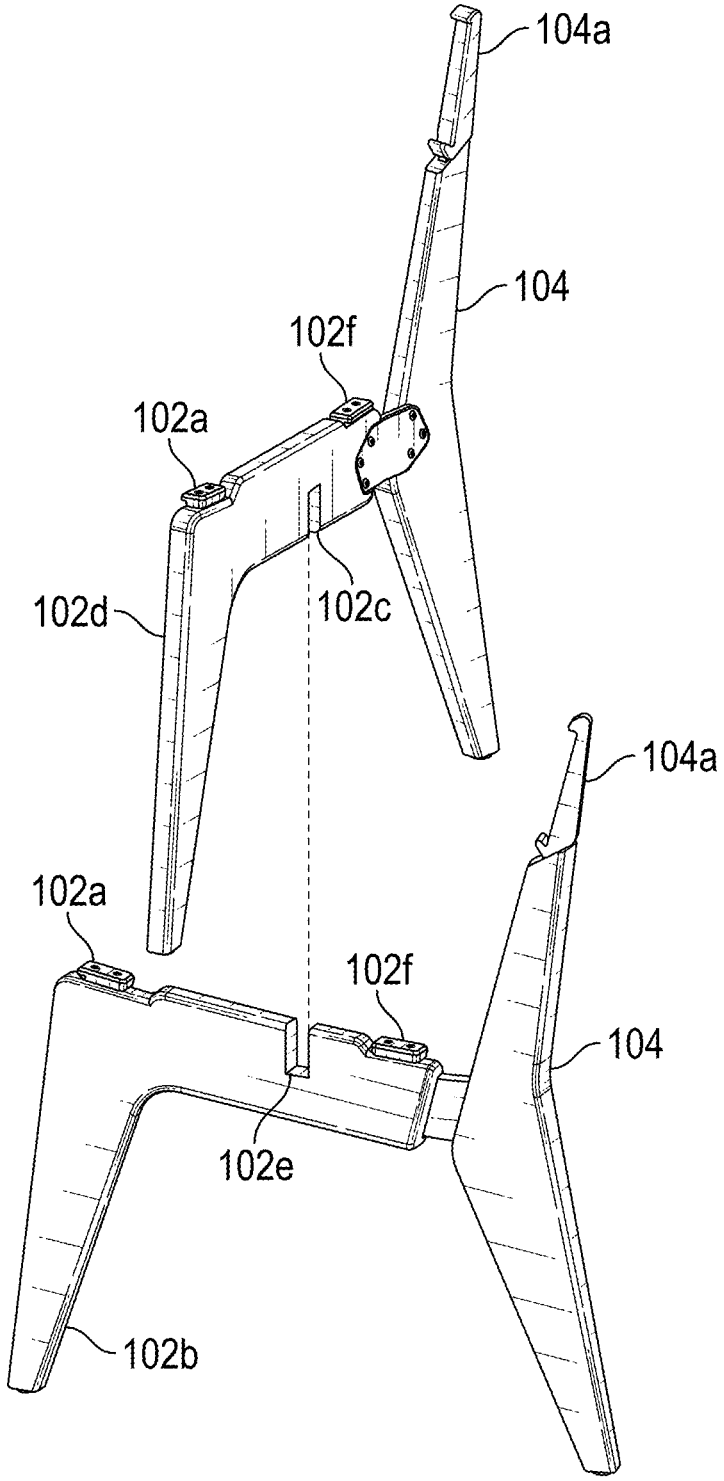
FIG. 3A illustrates how the two leg assemblies couple according to various aspects of the present disclosure.
Figure 3B:
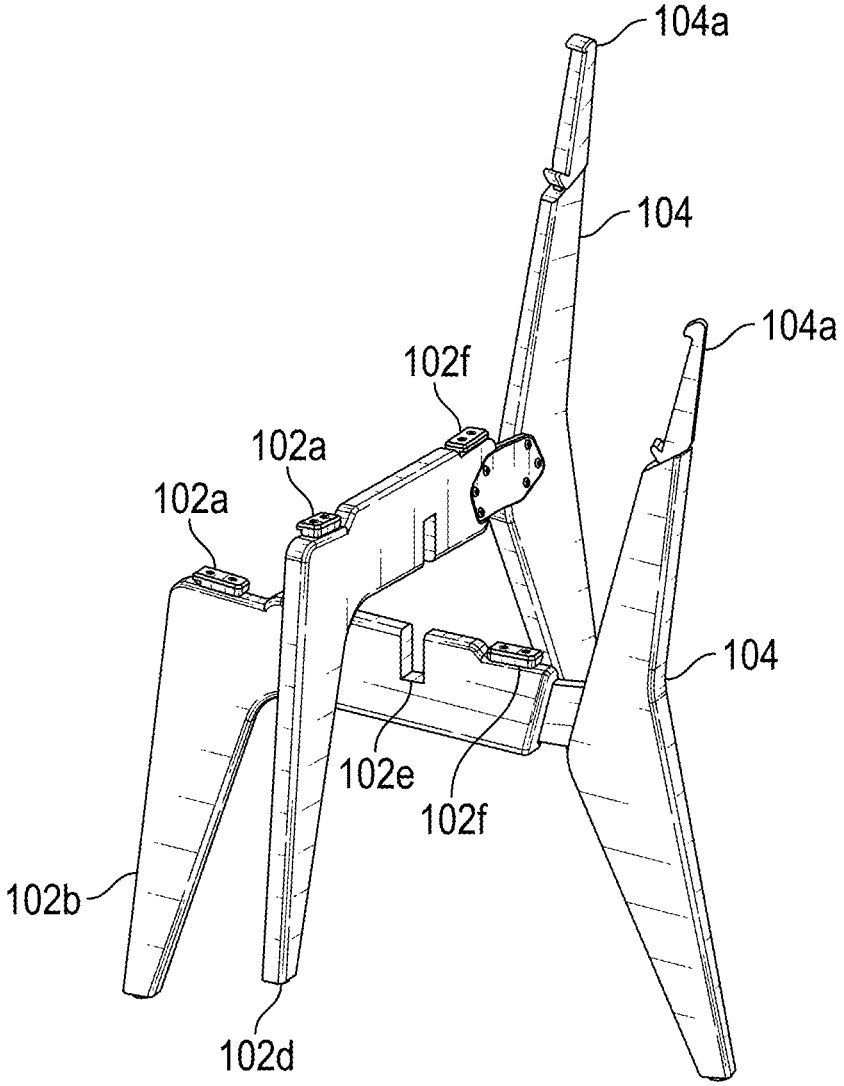
FIG. 3B illustrates how the two leg assemblies couple according to various aspects of the present disclosure.
Figure 3C:
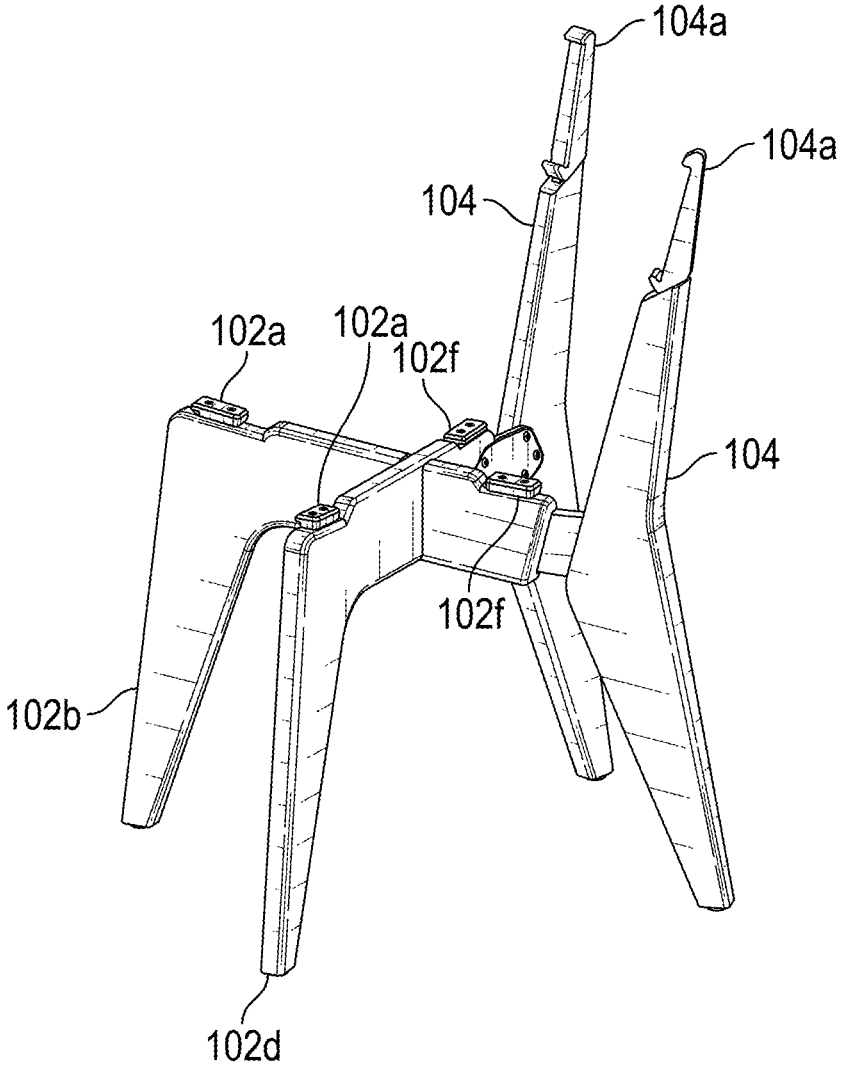
FIG. 3C illustrates how the two leg assemblies couple according to various aspects of the present disclosure.

FIG. 3A-C illustrates the method of coupling the two leg assemblies via the indentations 102*c*, 102*e* on the horizontal frames 102*b*, 102*d*. The horizontal frame 102*b* may comprise of a rectangular indention on the upper center portion of the frame. The horizontal frame 102*d* may comprise of a rectangular indention on the lower center portion of the frame. The shape of the indentations 102*e*, 102*c* may be any shape that allows a horizontal frame 102*d* to couple to the other horizontal frame 102*b* and 102*d* may lock together by aligning the indention 102*c* of the horizontal frame 102*d* with the indentation 102*e* of the other horizontal frame 102*b*. Once the horizontal frames 102*d*, 102*b* indentions 102*c*, 102*e* are aligned, the indention 102*c* of the horizontal frame 102*d* may be pushed down in the indention 102*e* of the bottom horizontal frame of 102*b* to form a sturdy lock.

The horizontal frames 102*b* and 102*d* may comprise of two separate "h-shaped" structures that slot together at or around ninety degrees, utilizing a cross-lap joint which may create a four-legged rigid frame with two vertical frames 104 for the backrest 108 of the chair. This method of joining the structures may allow them to be easily assembled and disassembled without any mechanical fasteners or adhesives. Furthermore, the system requires no screws, bolts, or tools for assembly. As a non-limiting example, the modular interlocking system can be utilized throughout the design to allow components to snap together without needing screws or bolts.

Figure 4A:
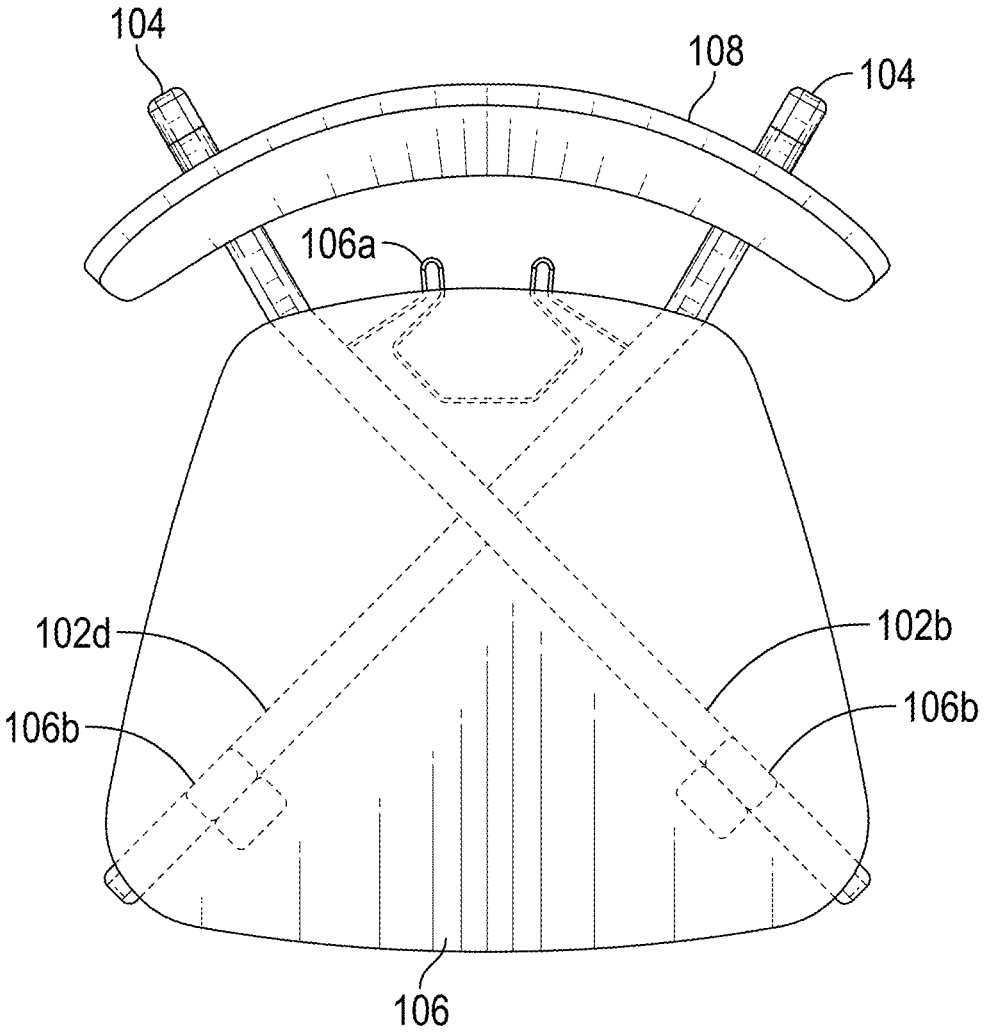
FIG. 4A-4G illustrates how the seat base attaches to the horizontal frames according to various aspects of the present disclosure.

FIG. 4A illustrates a top view of the chair 100. Additionally, this view illustrates transparency to the seat base 106. The seat base's 106 half-lap joints 106*b* may attach to the joint frames 102*a* on the horizontal frames 102*b*, 102*d*. Additionally, the bow-shaped joint 106*a* may attach to the frame joints 102*f* on the horizontal frames 102*b*, 102*d*. This secured seat base 106 enables a user to comfortably sit in the seat. The half-lap joints 106*b*, bow-shaped joint 106*a*, and joint frames 102*a*, 102*f* provide a secure and easy way to attach and disassemble the seat base 106 when needed.

Figure 4B:
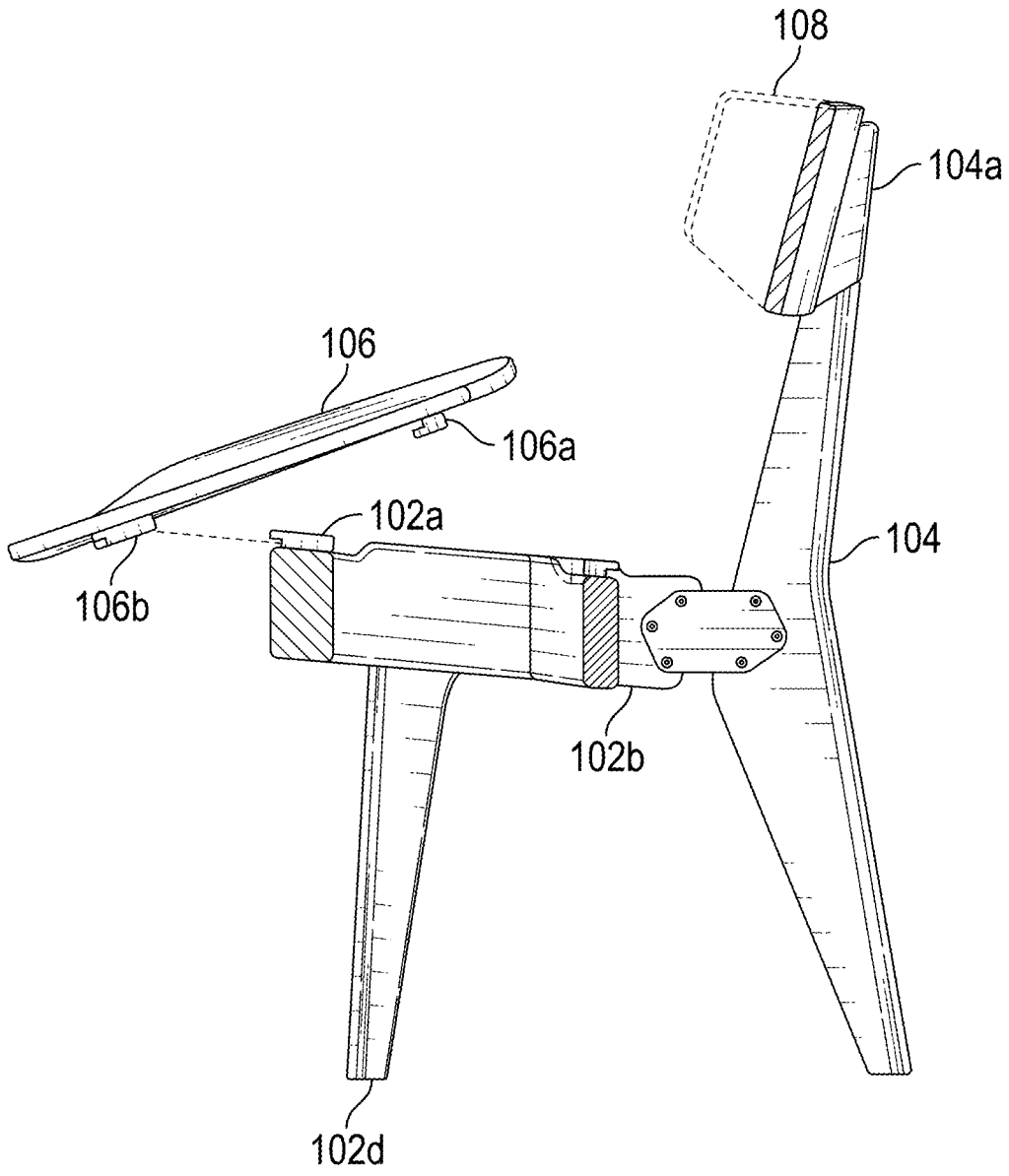
Figure 4C:
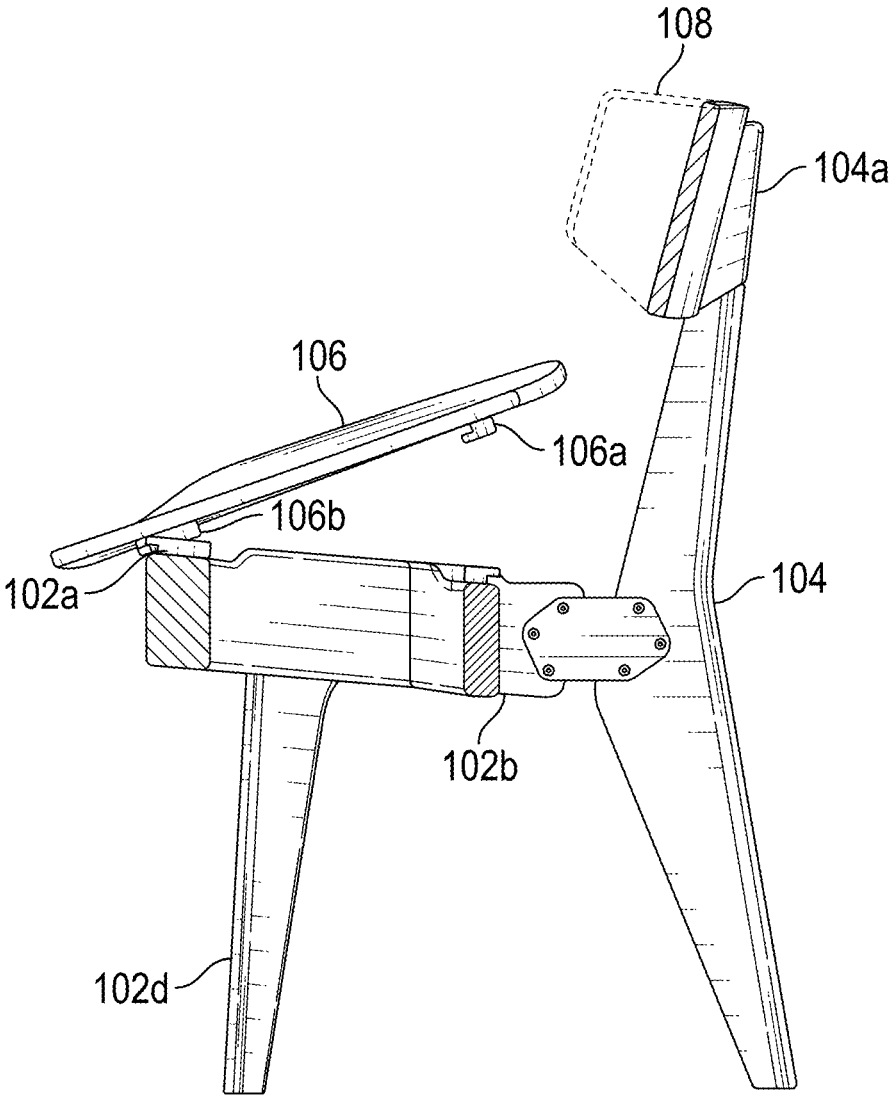
Figure 4D:
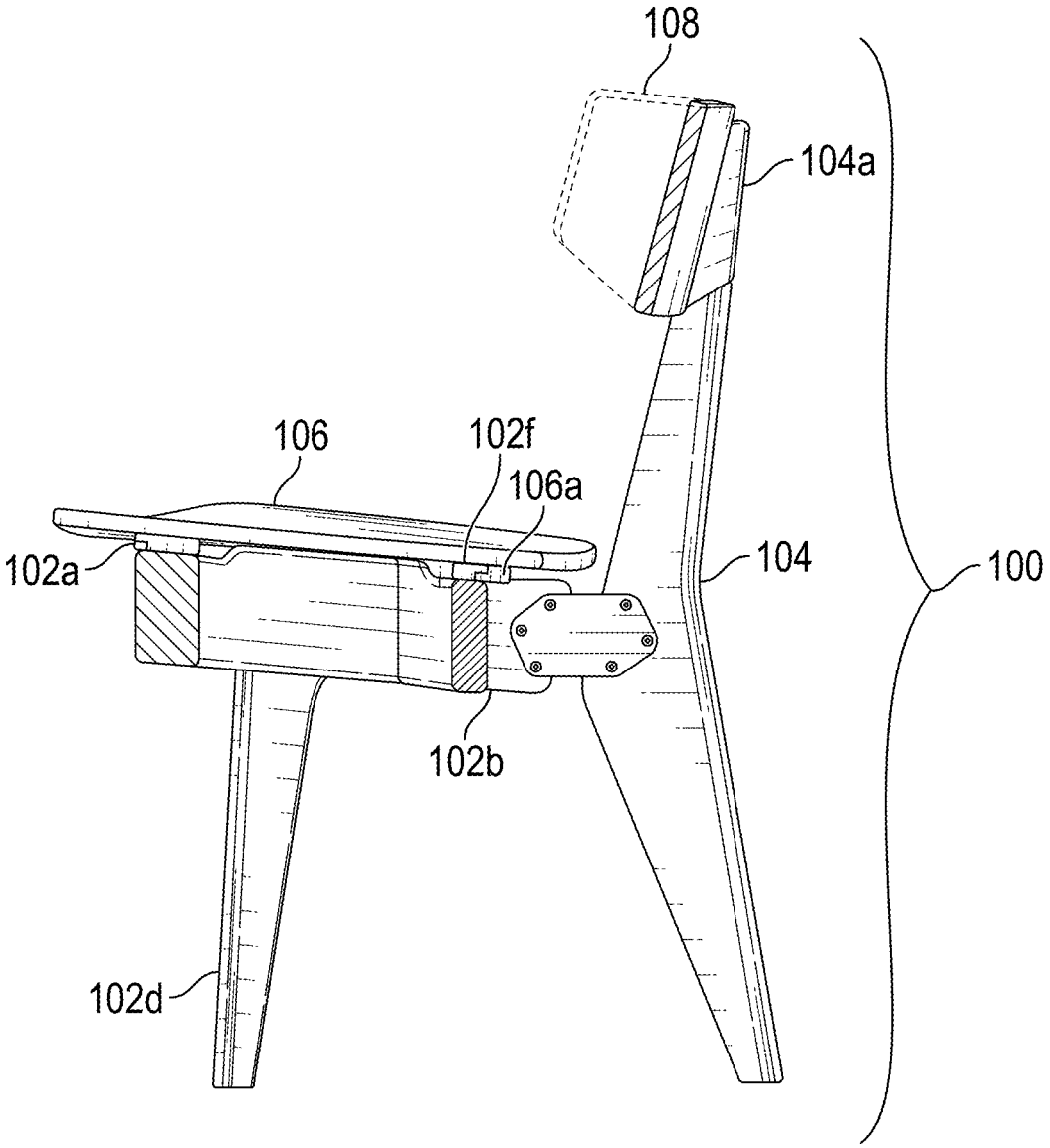

FIGS. 4B-D illustrate a method on how the seat base 106 attaches to the horizontal frames 102*b*, 102*d* using half lap joints 106*b* at the front of the seat and a flexible bow-shaped joint 106*a* that snaps into place at the rear of the seat. When the half-lap joints 106*b* are coupled together with the proximal joint frames 102*a*, they may act as a fulcrum for the bow-shaped joint 106*a* to rotate downwards and lock into the distal frame joints 102*f* on the horizontal frames 102*b*, 102*d* by squeezing the bow-shaped 106*a* joint inward into the frame joints 102*f*.

The seat base 106 also may act as a rigidifying element for the frame of the chair 100. The seat 106 may be easily removed by squeezing the two ends of the flexible bow together and releasing the back joint 106*a*. This method of joining the seat to the frame may allow users to easily assemble and disassemble the chair without mechanical fasteners.

The seat base 106 may be attached using only half-lap joints. This may be done by having two or more half-lap joints 106*b* and slotting all of them with a joint frame 102*a*. This would provide a seat base to secure onto the horizontal frames. Additionally, a seat base 106 may attach to horizontal frames 102*b*, 102*d*, with the use of only bow-shaped joints 106*a*. If more than one bow shaped joint 106*a* is secured onto frame joints 102*f* on the horizontal frames 102*b*, 102*d*, it may provide a secure way for a user to sit on the seat base. The seat base 106 may also be attached by using joints 102*a*, 102*f*, 106*a*, 106*b*, or other forms of attachment to the vertical frames 104. Furthermore, the seat base 106 may be attached using joints on the horizontal and vertical frames 102*b*, 102*d*, 104, or the vertical frames 104 only. Lastly, the seat base 106 may be attached to the horizontal frames 102*b*, 102*d* with the use of hook-shaped joints 104*a* and latches 108*a*. The latches 108*a* may be aligned to the flexible joints 104*a* and clipped in to secure the seat base 106.

Figure 4E:
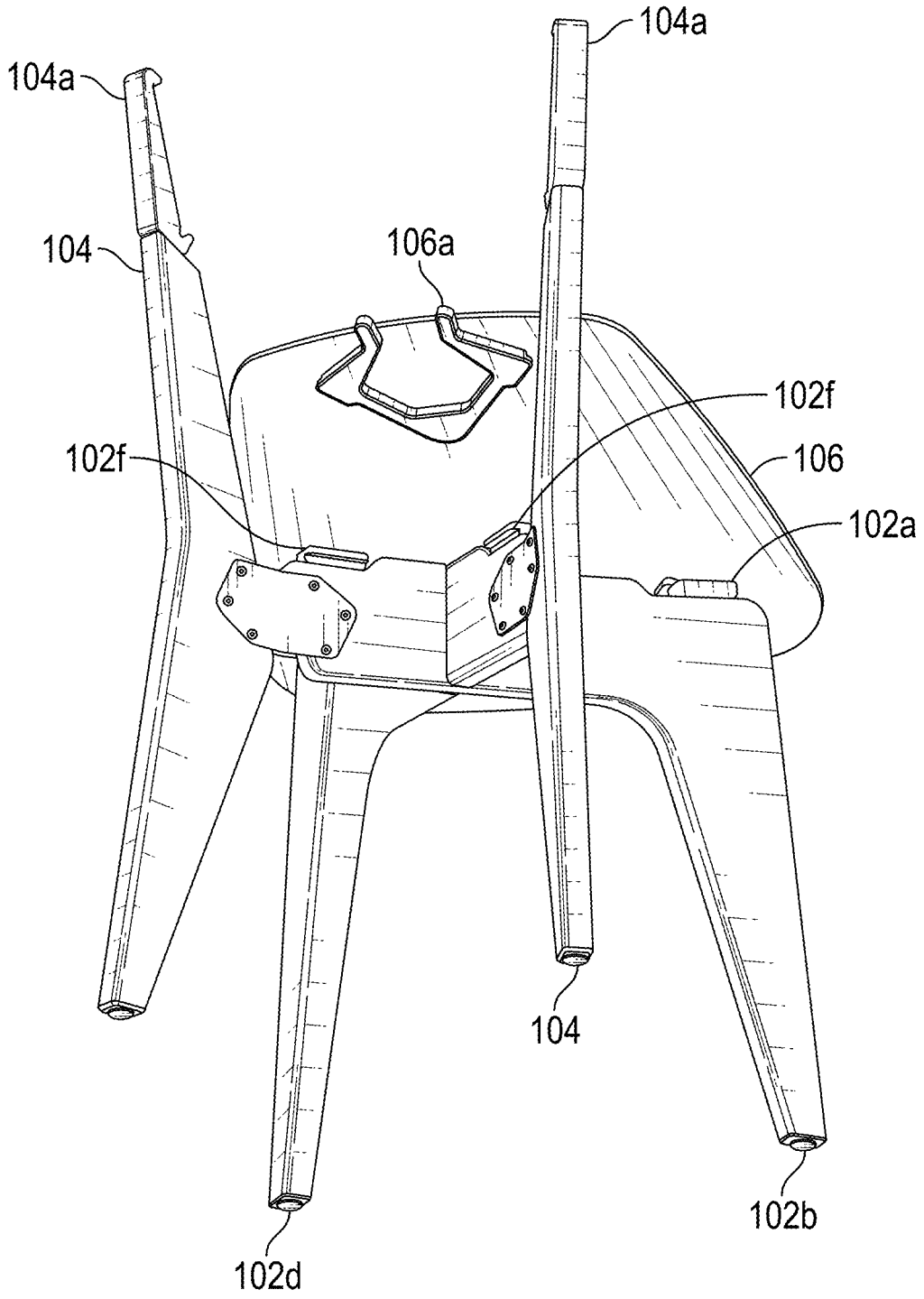
Figure 4F:
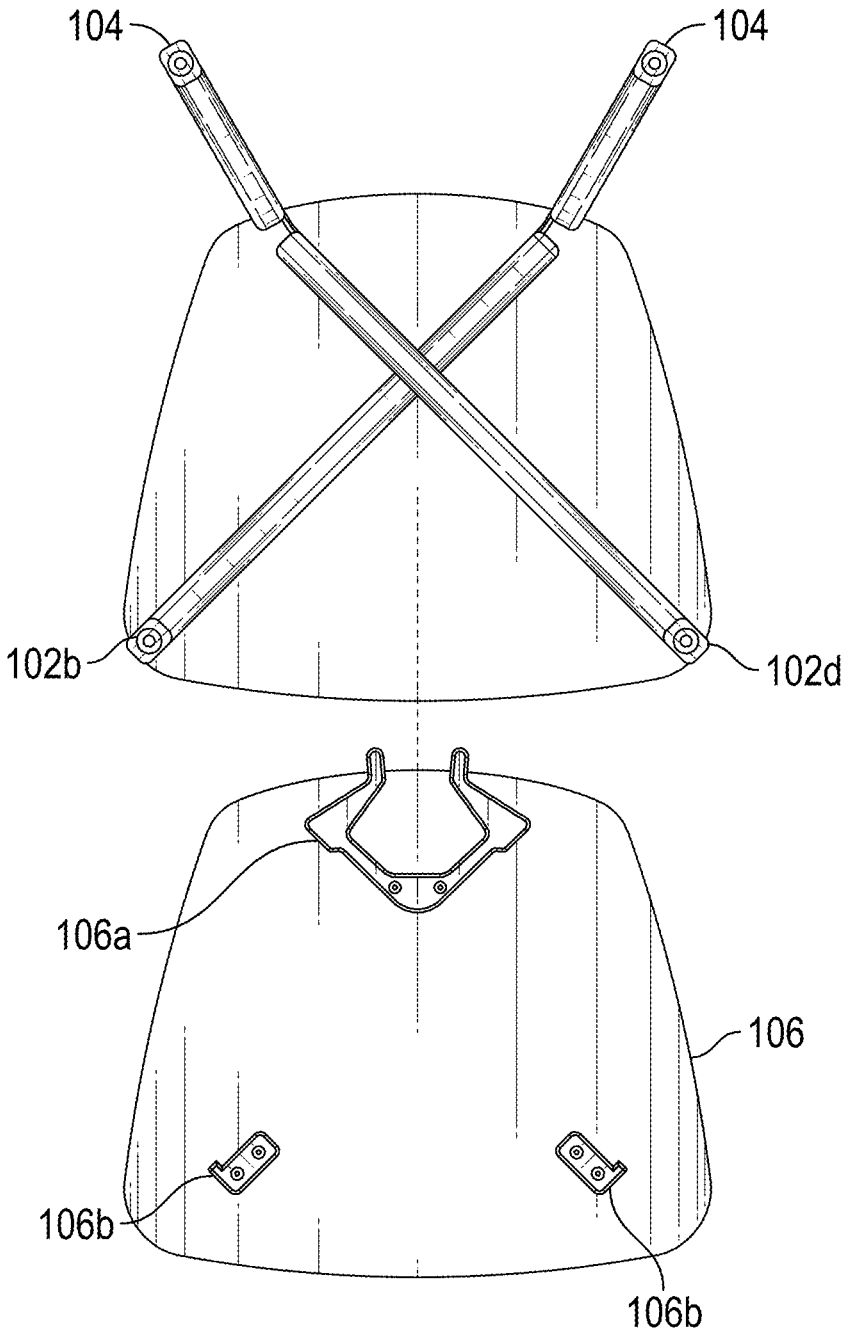
Figure 4G:
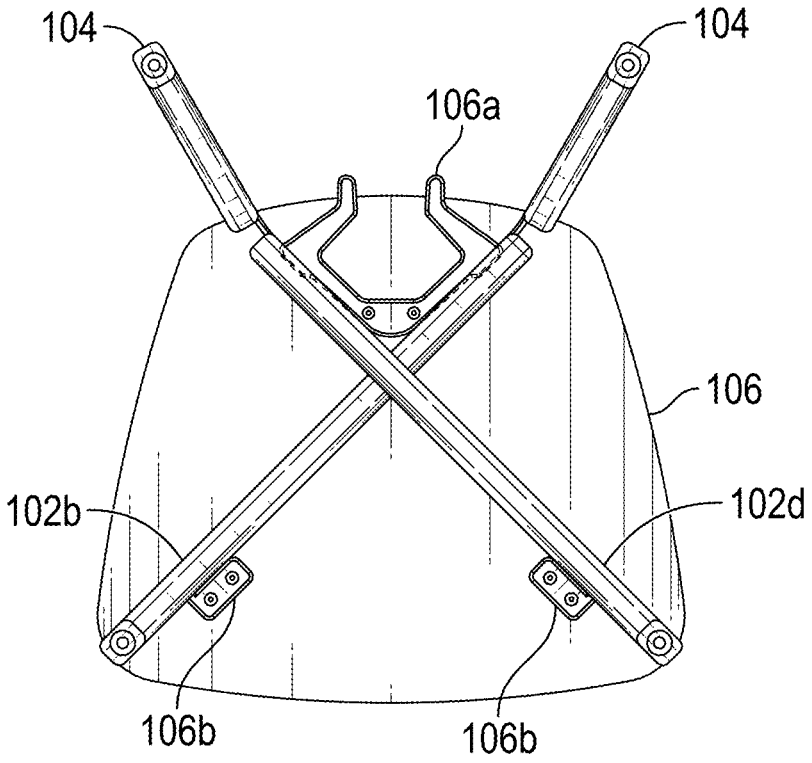

FIG. 4E-G illustrates the focus on the seat base 106 attachment to the horizontal frames 102*b*, 102*d*. The bow-shaped joint 106*a* may be secured into the joint frames' 102*f* projecting edges. Furthermore, the bow-shaped joint 106*a* may be squeezed inward between the joint frames' 102*f* projecting edges and once released, will be secured in place by the same joint frames' 102*f* projecting edges.

FIG. 4E-G illustrates the components of the self-locking joint system from an underside view. The bow-shaped joint 106*a* may be located in the distal intersection of the horizontal frames 102*b*, 102*d* when secured to the joint frames 102*f*. The bow-shaped joint 106*a* may also be located in any other intersection created by the horizontal frames 102*b*, 102*d* in order to secure to the horizontal frames 102*b*, 102*d*. The half-lap 106*b* joints may be located on the proximal side of the seat base 106 or where there is a way to fix the half-lap joints 106*b* onto horizontal frames 102*b*, 102*d* with the use of the joint frames 102*a*.

Figure 5A:
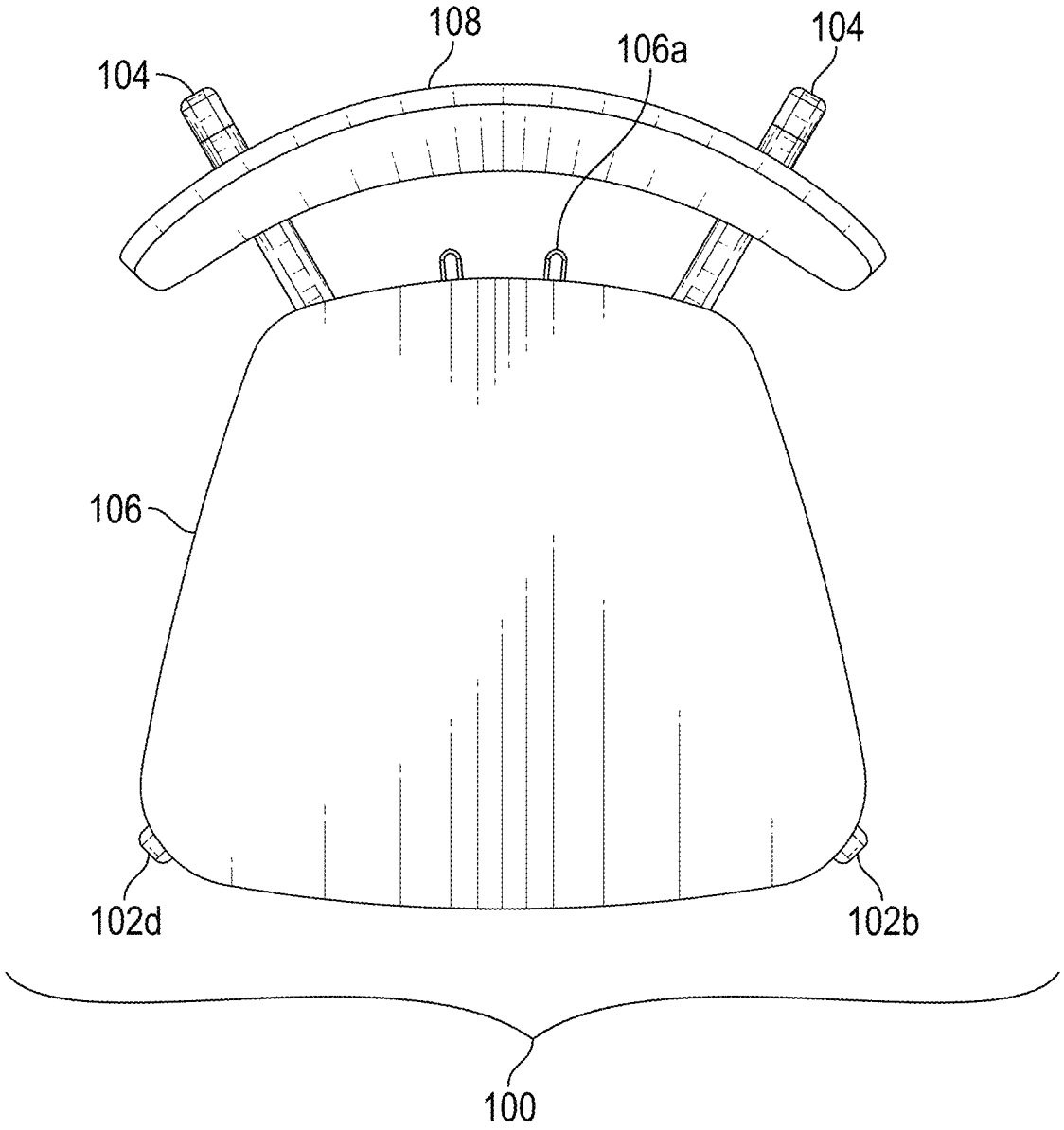
FIG. 5A-5E illustrates how the backrest attaches to the vertical frames according to various aspects of the present disclosure.
Figure 5E:
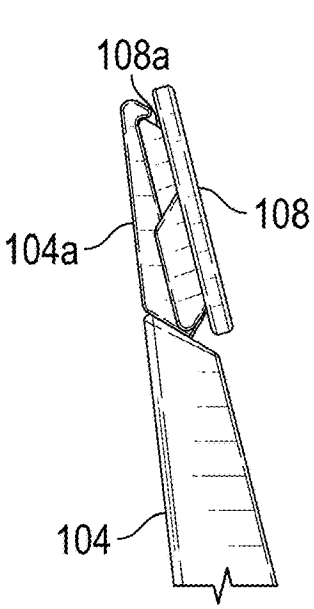
Figure 5D:
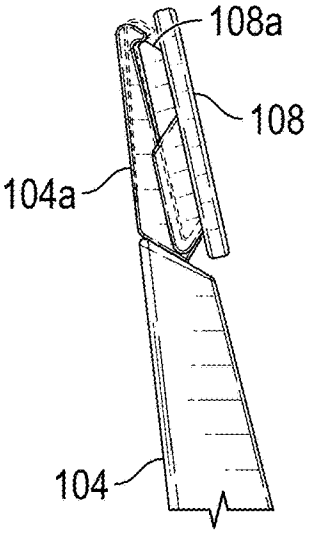
Figure 5C:
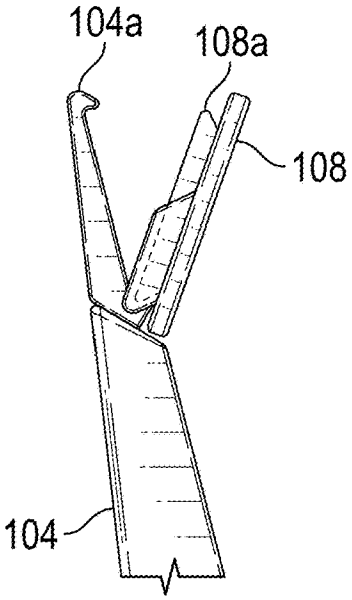
Figure 5B:
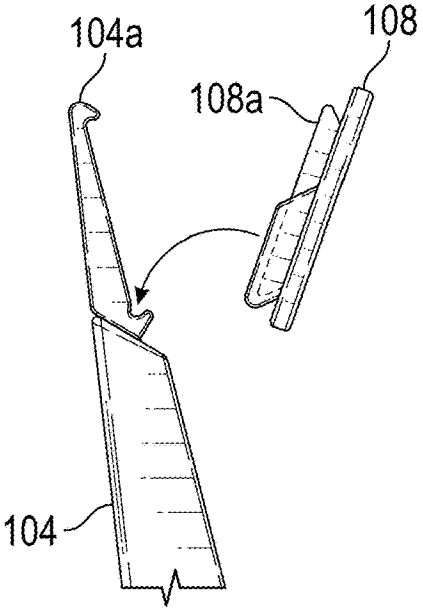

FIG. 5A illustrates an aerial view of the chair 100. The bow-shaped joint 106*a* may be visible and easy to locate so a user may easily detach the seat base 106 from the horizontal frames 102*b*, 102*d*. The backrest 108 may have a curved figure to allow a user to sit comfortably and allow the chair 100 to fit the contours of their body. The backrest 108 may also be rectangular, circular, square, or any other shape that may allow a user to sit comfortably.

FIG. 5B-5E illustrates a method on how to attach the backrest 108 to the hook-shaped joints 104*a*. The hook-shaped joints 104*a* may be attached to vertical frames 104 in order for the backrest 108 to attach to the chair 100. Such attachment of the hook-shaped joints 104*a* to the vertical frame 104 may be done in a variety of ways, including screws, glue, and other attachment methods.

In order for the backrest 108 to securely attach to the hook-shaped joints 104*a*, the backrest may comprise latches 108*a*. The latches 108*a* may be placed on the top left side, bottom left side, top right side, and bottom right side of the backrest 108, or anywhere that allows the latches 108*a* to secure to the hook-shaped joints 104*a*. The latches 108*a* may be spaced enough to align with the hook-shaped joints 104*a* in order to attach properly.

When attaching the backrest 108, the bottom sections of the latches 108*a* may be secured in the hook-shaped joints 104*a* first. Once the bottom sections of the latches 108*a* are secured into the hook-shaped joints 104*a*, the top sections of the latches 108*a* of the backrest 108 may be pushed into the hook-shaped joints 104*a* to create a secure lock.

The backrest 108 may be easily removed by pressing the top edge of each hook-shaped joint 104*a*, one at a time, and pushing it backward. This may allow the top of the backrest 108 to become free from the top section of the latches 108*a*, at which point it can be lifted upwards and removed.

The hook-shaped joints 104*a* on the vertical frames 104 may be configured with two hooked shapes on the top and bottom of the hook-shaped joints 104*a*. This may allow the hook-shaped joints 104*a* to hook onto the latches 108*a* of the backrest 108. The latches 108*a* of the backrest 108 may be shaped to have the bottom section of the latches 108*a* to protrude more than the top section of the latches 108*a*. This may allow the hook-shaped joints 104*a* to be secured by hooking onto the protruded bottom section of the latch 108*a* in order to ensure a stiff attachment with no movement of the backrest 108 when in use. This elongation and protrusion of the latches 108*a* may be any measurement that would allow the hook-shaped joint 104*a* to have a secure attachment.

The backrest 108 may also secure to the vertical frames 104 in other ways. This may include the backrest having half-lap joints 106*b* that secure onto joint frames 102*a* that are attached to the vertical frame 104 by vertically aligning the half-lap joints 106*a* to the joint frames 102*a* and securing them to one another. Another way the backrest 106 rest may attach to the vertical frames 104, is by using joint frames 102*f* on the backrest 106 and bow-shaped joints 106*a* on the vertical frames 104 to lock in the backrest 106 when the bow-shaped joints 106*a* are locked in between two or more joint frames 102*f*.

What is claimed is:

1. A self-locking chair apparatus, comprising:

a first and second vertical frame each comprising a joint attached at the top of the first and second vertical frames; and a first and second horizontal frame each comprising a first and second frame joint attached to a top surface of the first and second horizontal frames, wherein the first horizontal frame has an indentation on an intermediate underside section and the second horizontal frame has an indentation on an intermediate topside section, wherein the first horizontal frame attaches to the first vertical frame and the second horizontal frame attaches to the second vertical frame to form a first and second leg assembly; and a backrest with a first and second latch attached to a back section of the backrest; and a seat base with a first and second half lap joint attached to a proximal underside section of the seat base and a bow-shaped joint attached to a distal underside section of the seat base.

2. The self-locking chair of claim 1, wherein the first and second frame joints attach to a proximal end of the first and second horizontal frame and the first and second frame joints attach to a distal end of the first and second horizontal frame.

3. The self-locking chair of claim 1, wherein the first and second latch are attached to opposing horizontal sides of the back section of the backrest.

4. The self-locking chair of claim 1, wherein the first and second half lap joint are attached to a proximal side and positioned in opposing horizontal alignment on the underside section of the seat base.

5. The self-locking chair of claim 1, wherein the first and second horizontal frames attach to the first and second vertical frames via a hinge mechanism to form the first and second leg assemblies.

6. The self-locking chair of claim 5, wherein each hinge mechanism includes of a first, second, and third screw securing the first and second horizontal frames to the first and second vertical frames.

7. The self-locking chair of claim 1, wherein the latches, half lap joints, joints, frame joints, and bow-shaped joint includes a recycled high-density polyethylene plastic.

8. The self-locking chair of claim 1, wherein the indentations on the first and second horizontal frames are a rectangular shape or a shape that would secure the first and second horizontal shapes to couple to one another.

9. The self-locking chair of claim 1, wherein the backrest is a curved shape.

10. The self-locking chair of claim 1, wherein the first and second vertical frames, first and second horizontal frames, backrest, and seat base are composed of wood or plastic.

11. The self-locking chair of claim 1, wherein the joint attached to the vertical frames have a hooked shape on a top and bottom section of the joint or any shape that provides latches to be clicked in securely.

12. A method of assembling the self-locking chair apparatus of claim 1, comprising the steps of:

coupling the first leg assembly to the second leg assembly, wherein the indentation on the intermediate underside section of the first leg assembly aligns with and is pushed downward into the indentation on the intermediate topside portion of the second leg assembly, thereby securing the two leg assemblies together; and securing the backrest onto the first and second vertical frames, wherein the first and second latch on the back of the backrest aligns with and secures on the first and second joint attached to the top of the first and second vertical frames, thereby providing a secure attachment of the backrest to the two secured leg assemblies; and securing the seat base onto the first and second horizontal frames, wherein the first and second half lap joint attached to the proximal underside section of the seat base are aligned and secured to the first and second frame joint on the proximal end of the first and second horizontal frames, wherein the bow-shaped joint attached to the distal underside section of the seat base is clipped to the first and second frame joints attached to the distal side of horizontal frames.

13. The method of claim 12, wherein each latch attached to the backrest is secured to a respective joint attached to the vertical frames by placing the bottom of each latch into the joint and then pushing the top of the latch into the joint, such that each hook on the joint engages with the top and bottom of each latch to secure them together.

14. The method of claim 12, wherein the first and second half-lap joint attached to the seat base horizontally slides into the first and second frame joints on the proximal end of horizontal frame to interlock, and the distal side of the seat base is then pushed downward, while squeezing the bow-shaped joint inward in order to clip into the first and second frame joints near the intersecting horizontal frames, thereby securing the seat base to the first and second secured leg assemblies.

15. The method of claim 14, wherein the intersecting horizontal frames are oriented at a 90-degree angle.

16. The method of disassembling the self-locking chair apparatus of claim 1, comprising the steps of:

releasing the seat base from the horizontal frames, wherein the bow-shaped joint attached to the distal underside section of the seat base is disengaged to the first and second joint frames attached to the distal end of the first and second horizontal frames and that are near the intersection of the first and second horizontal frames, wherein the first and second half-lap joints attached to the proximal underside section of the seat base is disengaged with the first and second joint frames attached to the proximal ends first and second horizontal frames providing the removal the seat base from the two secured leg assemblies; and releasing the backrest from the first and second vertical frames, wherein the first and second latches on the back of the backrest are disengaged from the first and second joint attached on the top of the first and second vertical frames providing the removal of the backrest from the "h-shaped frames"; and decoupling the first and second 'h-shaped' frames from one another, wherein the first leg assembly is hoisted in an upward manner providing the removal of the first leg assembly from the second "h-shaped frame.

17. The method of claim 16, wherein the bow-shaped joint attached to the distal underside section of the seat base is squeezed inward and vertically disengaged from the first and second joint frames attached to the distal end of the horizontal frames and the half lap joints attached to the proximal underside section of the seat base are pulled laterally from the first and second joint frames attached to the proximal end of the horizontal frames providing for the removal of the seat base from the first and second leg assemblies.

18. The method claim of 16, wherein the first and second latch attached to the back of the backrest is disengaged to a respective joint attached to the top of the first and second vertical frames by withdrawing a top section of the first and second latch from a top section of the first and second joints providing for the bottom section of the first and second latches attaches to the back of the backrest.

19. The method of claim 16, wherein the intersecting horizontal frames are oriented at a 90-degree angle.

20. The method of claim 16, wherein the first leg assembly is decoupled by hoisting the first horizontal frame from the second horizontal frame providing a release of the indentation in the first horizontal frame from the indentation in the second horizontal frame.

* * * * *